US006902163B2

(12) United States Patent
Coster et al.

(10) Patent No.: US 6,902,163 B2
(45) Date of Patent: Jun. 7, 2005

(54) GAMES AND ASSOCIATED DEVICE AND METHODS

(75) Inventors: Ora Coster, Tel Aviv (IL); Theo Maurice Simon Coster, Tel Aviv (IL)

(73) Assignee: ThinkFun, Inc., Alexandria, VA (US)

( * ) Notice: Subject to any disclaimer, the term of this patent is extended or adjusted under 35 U.S.C. 154(b) by 32 days.

(21) Appl. No.: 10/360,993

(22) Filed: Feb. 6, 2003

(65) Prior Publication Data

US 2003/0151196 A1 Aug. 14, 2003

Related U.S. Application Data

(60) Provisional application No. 60/355,931, filed on Feb. 11, 2002.

(51) Int. Cl.[7] ..... A63F 1/14

(52) U.S. Cl. ..... 273/149 R; 221/104; 221/106; 273/272

(58) Field of Search ..... 273/149 R, 149 P, 273/148 R, 144 A, 144 B, 272; 221/99, 93, 104, 106, 111, 112, 223, 256, 268, 269, 270, 272

(56) References Cited

U.S. PATENT DOCUMENTS 1,846,063 A * 2/1932 Matthaey ..... 273/149 R
3,315,841 A * 4/1967 Kirkhof ..... 221/223
4,014,548 A 3/1977 Trilling
4,201,389 A 5/1980 Vowell
4,309,035 A 1/1982 Goldfarb
4,601,473 A 7/1986 Dubren et al.
4,619,375 A * 10/1986 Kathari ..... 221/186
4,732,387 A 3/1988 Elinski
5,100,018 A * 3/1992 Rosati et al. ..... 221/6
6,109,925 A 8/2000 Druckman et al.
6,168,439 B1 1/2001 Anderson

* cited by examiner

*Primary Examiner*—William M. Pierce
(74) *Attorney, Agent, or Firm*—Allen, Dyer, Doppelt, Milbrath & Gilchrist, P.A.

(57) ABSTRACT

A word game includes displaying a first and a second letter from which players form an answer word. A winner is determined when an answer word conforming to an established rule set is submitted. A game-piece dispenser includes a base having two depressions in a top face located closer to a front edge than to a rear edge of the base. The depressions have a depth dimensioned to hold a unitary game piece having an indicium thereon. A game-piece holder having two receptacles with bottom openings is affixed in sliding relation atop the base and is movable between a rear position wherein the receptacle openings are in spaced relation from the depressions and a forward position wherein the receptacle openings are in covering relation to at least a portion of the depressions for depositing a game piece into each depression.

17 Claims, 7 Drawing Sheets

GAMES AND ASSOCIATED DEVICE AND METHODS

CROSS-REFERENCE TO RELATED APPLICATION

This application claims priority to provisional application Ser. No. 60/355,931, filed on Feb. 11, 2002, entitled "Word Game and Associated Methods."

BACKGROUND OF THE INVENTION

1. Field of the Invention

The present invention relates to games, including word games, devices for playing games, and methods associated therewith.

2. Description of Related Art

Word games are known in the art that include manipulating individual letters to form words. "Bingo"-type games are also known in the art, including many playing variations. Game-piece dispensers are additionally known in the art, for example, "shoes" for dispensing playing cards in casinos.

SUMMARY OF THE INVENTION

A first aspect of the present invention includes a word game. Associated with this aspect are methods of playing a word game and a method of teaching spelling.

In a particular embodiment of a method of playing a word game of the present invention comprises the step of displaying a first letter and a second letter to a plurality of players. Each of the plurality of players attempts to form an answer word using the first and the second letters therein. A winner is determined when an answer word conforming to an established rule set is submitted by at least one from among the plurality of players.

The word game invention includes various embodiments of rule sets. For example, the object of the game may be to form a word beginning with the first letter and ending with the second letter. In another embodiment, the winning word may comprise the shortest word presented by the players that uses both letters therein. It will be understood by one of skill in the art that numerous rule sets may be contemplated, and that the invention is not intended to be limited to a particular rule set.

A second aspect of the present invention is directed to a device for playing a game, here, a game-piece dispenser. Associated with this aspect is a method for making a game. The dispenser comprises a base having a first and a second depression in a top face thereof. The first and the second depression are located closer to a front edge than to a rear edge of the base. The first and the second depression have a depth dimensioned to hold a unitary game piece.

The dispenser further comprises a game-piece holder comprising a first and a second receptacle. Each receptacle has an opening at a bottom thereof. The game-piece holder is affixed in sliding relation atop the base and is movable between a rear position wherein the first and the second receptacle openings are in spaced relation from the depressions and a forward position wherein the first and the second receptacle openings are in covering relation to at least a portion of the depressions.

The word game further comprises a plurality of game pieces, each game piece having an indicium on a face thereof. The game pieces are dimensioned to reside in vertically stacked relation one atop another within the first and the second receptacle and to be dispensed from the first and the second receptacle through the openings into the depressions when the game piece holder is in the forward position.

A method of playing a game also forms an aspect of the present invention, wherein a first and a second game piece are dispensed with a dispenser as disclosed above for display to a plurality of players. The players are then permitted to perform a game move utilizing the indicia on the game pieces. The game move is governed by an established rule set.

In alternate embodiments of the dispenser, a greater number of receptacles may be provided for dispensing a multiplicity of game pieces. A word game associated with such an embodiment would then entail forming a word containing the multiplicity of letters, for example, in the order dispensed.

In alternate embodiments of the method, the letters may be placed in different positions from the first and last; for example, the letters may be used as the first two letters of a word.

In addition, the dispenser of the present invention may be used to play other types of games, such as, but not intended to be limited to, a "Bingo"-type game.

The features that characterize the invention, both as to organization and method of operation, together with further objects and advantages thereof, will be better understood from the following description used in conjunction with the accompanying drawing. It is to be expressly understood that the drawing is for the purpose of illustration and description and is not intended as a definition of the limits of the invention. These and other objects attained, and advantages offered, by the present invention will become more fully apparent as the description that now follows is read in conjunction with the accompanying drawing.

DETAILED DESCRIPTION OF THE PREFERRED EMBODIMENTS

Figure 1:
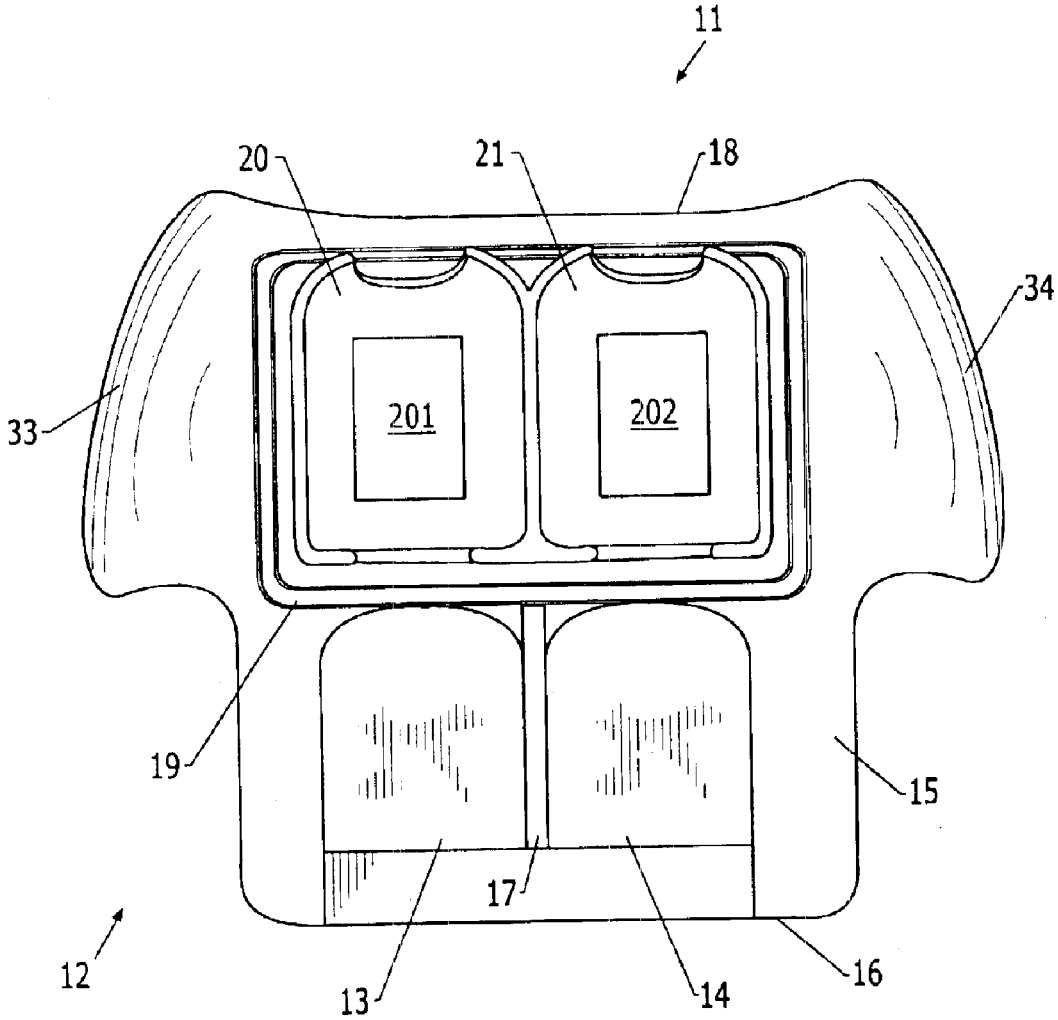
FIG. 1 is a top plan view of the dispenser of the present invention prior to being loaded with game pieces.

A description of the preferred embodiments of the present invention will now be presented with reference to FIGS. 1–7.

The game apparatus 10 comprises a dispenser 11, which in turn comprises a base 12 having a first 13 and a second 14 depression in a top surface 15 thereof. The depressions 13,14 are positioned closer to a front edge 16 than to a rear edge 18. The dispenser 11 has a slot 17 extending from adjacent the front edge 16 to adjacent the rear edge 18. The slot 17 is generally perpendicular to the front edge 16.

The dispenser 11 further comprises a game-piece holder 19 comprising a first 20 and a second 21 receptacle. Each receptacle 20,21 has an opening 201,202 at a bottom 24,25 thereof. The game-piece holder 19 is affixed in sliding relation to the base 12 and is movable from a rear position (FIGS. 2,3) wherein the receptacle openings 201,202 are in spaced relation from the depressions 13,14, respectively, and a forward position (FIG. 4) wherein the receptacle openings 201,202 are in covering relation to at least a portion of the depressions 13,14. The depressions 13,14 have a depth 131.

The game-piece holder 19 additionally comprises a downwardly depending slide member 26 (FIG. 6), a top portion of which is dimensioned to slide within the slot 17. A bottom portion 262 is larger than the slot 17, for retaining the game-piece holder 19 atop the base 12.

The base 12 further has a pair of laterally extending wings 33,34 adjacent the rear edge 18. The wings 33,34 are for permitting a user to grasp one of the wings 33,34 with a first hand while sliding the game-piece holder 19 with a second hand.

The word game apparatus 10 additionally comprises a removable holder cover 27 that is dimensioned to fit in covering relation to at least a portion of the game-piece holder 19. The cover 27 comprises a substantially rectangular box-like member having four walls 28, an enclosed top 29, and an open bottom 30 dimensioned to slide over at least a portion of the game piece holder 19. The cover 27 is for concealing the indicia 32 on game pieces 31 residing in the first 20 and the second 21 receptacles when in use.

The word game apparatus 10 further comprises a plurality of substantially planar tile-like game pieces 31, each game piece 31 having one indicium 32 inscribed on at least one face 311 thereof. In a particular embodiment, not intended to be limiting, 72 game pieces 31 are provided, with each indicium 32 comprising a letter. Some letters present more than once and others, for example, F, I, J, U, V, X, and Z being absent. These representations were decided upon in an exemplary version of the game for ease of play by children, and are not intended as limitations.

Figure 4:
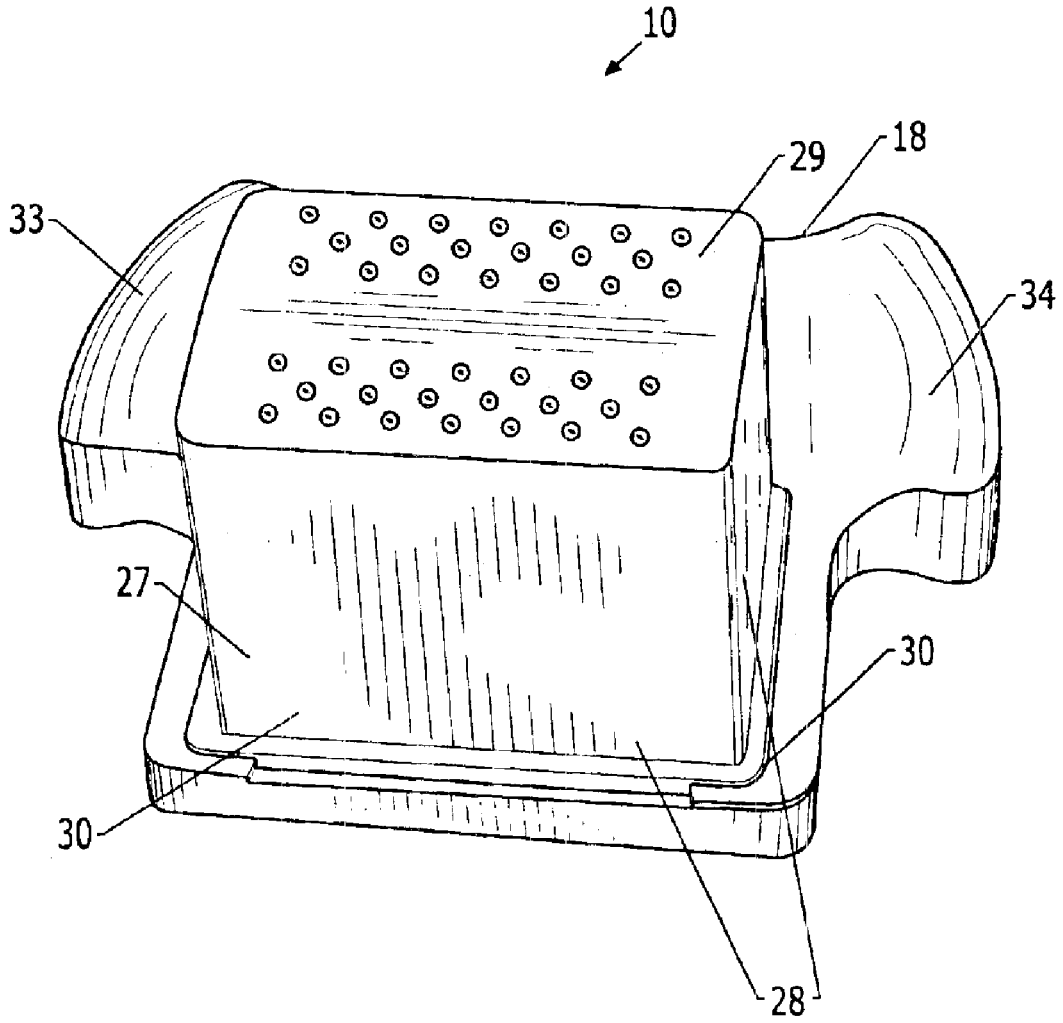
FIG. 4 is a top front perspective view of the covered dispenser in the forward position.
Figure 5:
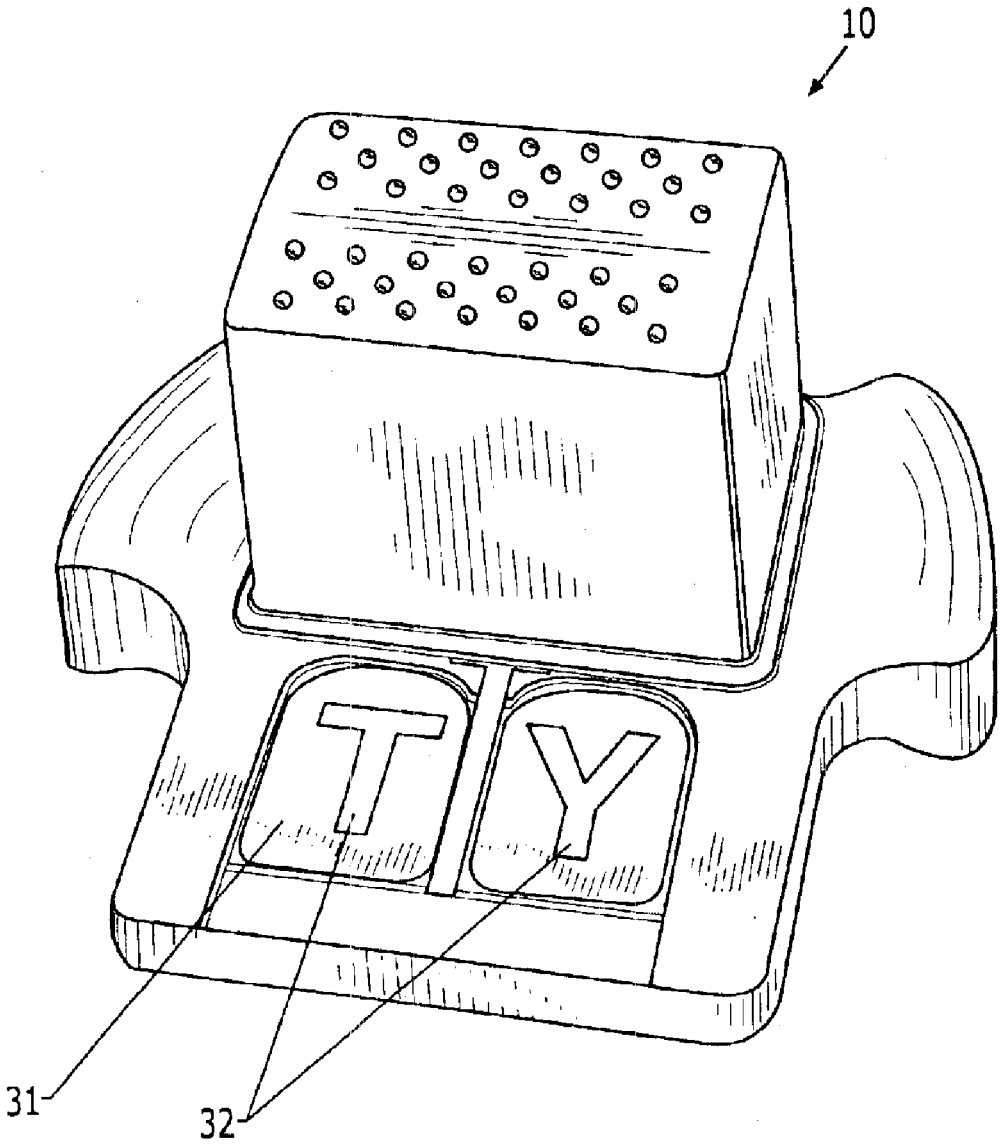
FIG. 5 is a top front perspective view of the covered dispenser in the rear position having dispensed two letters.
Figure 6:
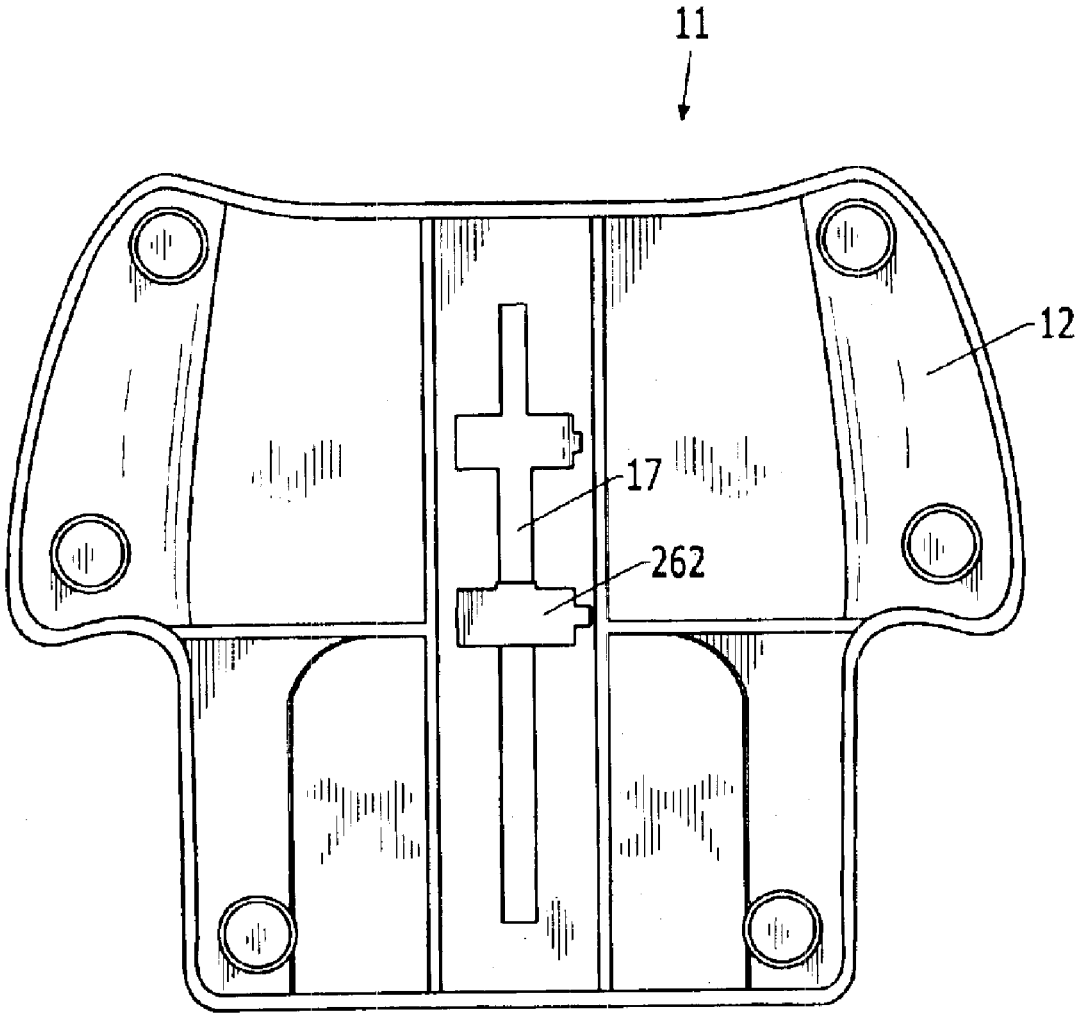
FIG. 6 is a bottom plan view of the dispenser.
Figure 7:
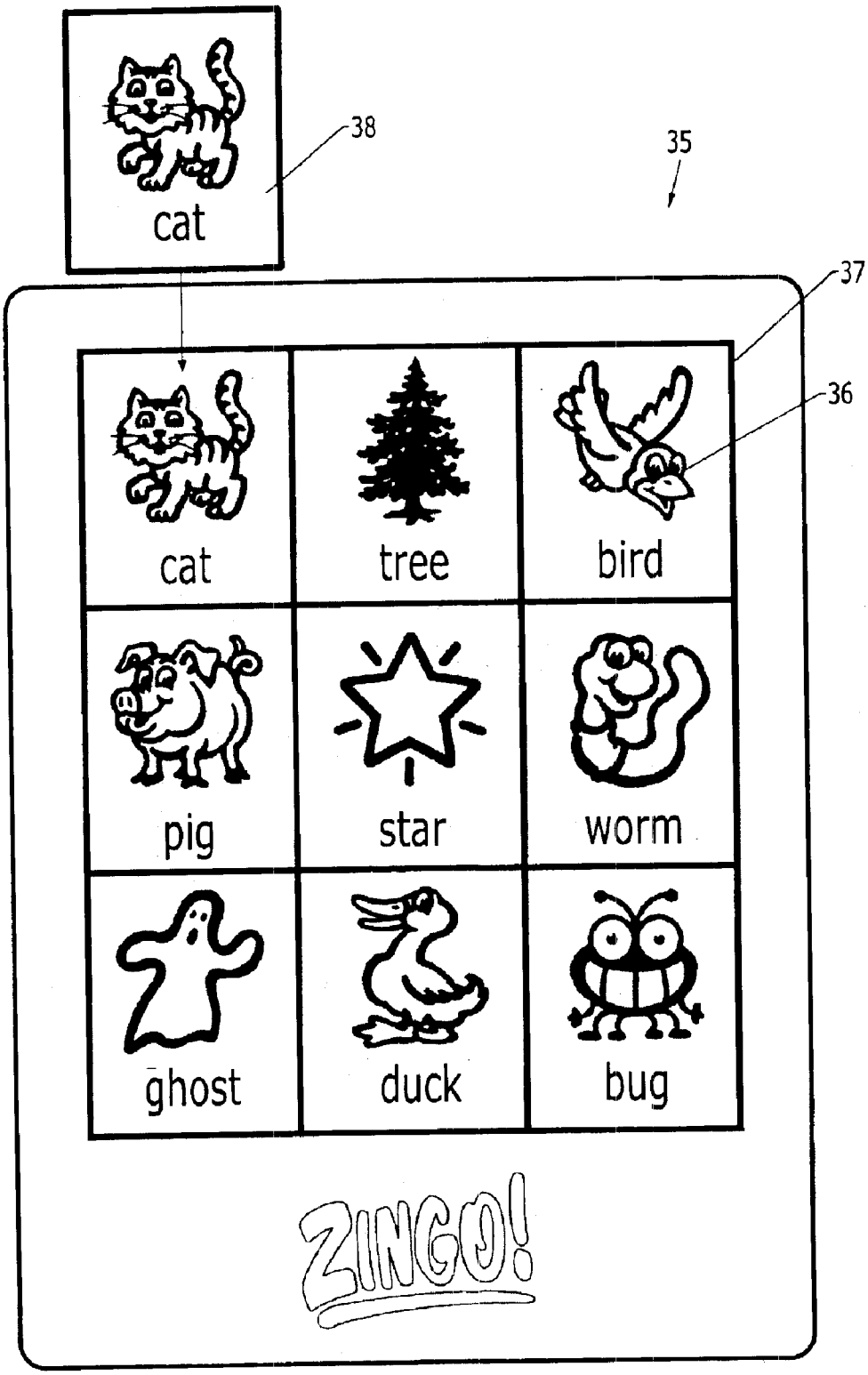
FIG. 7 is a top plan view of a playing card for another embodiment of a game of the present invention.

The game pieces 31 are dimensioned to reside in vertically stacked relation one atop another within the receptacles 20,21 and to be dispensed from the receptacles 20,21 through the openings onto the depressions 13,14 when the game-piece holder 19 is in the forward position (FIG. 4). The game pieces 31 and the depressions 13,14 are respectively dimensioned so that a unitary game piece 31 can reside in a depression 13,14 at a time, with the top surface, here the face 311 having the indicium 32 inscribed thereon, of the game piece 31 no higher than the top surface 15 of the base 12; that is, the depth 131 of the depressions 13,14 is at least as great as the height 312 of one game piece 31. When the game-piece holder 19 is in the forward position (FIG. 4), two game pieces 31, one from each receptacle 20,21, are deposited into the depressions 13,14. The game pieces 31 are then left behind in the depressions 13,14 for viewing by the game players when the game-piece holder 19 is moved back into the rear position (FIG. 5).

Figure 2:
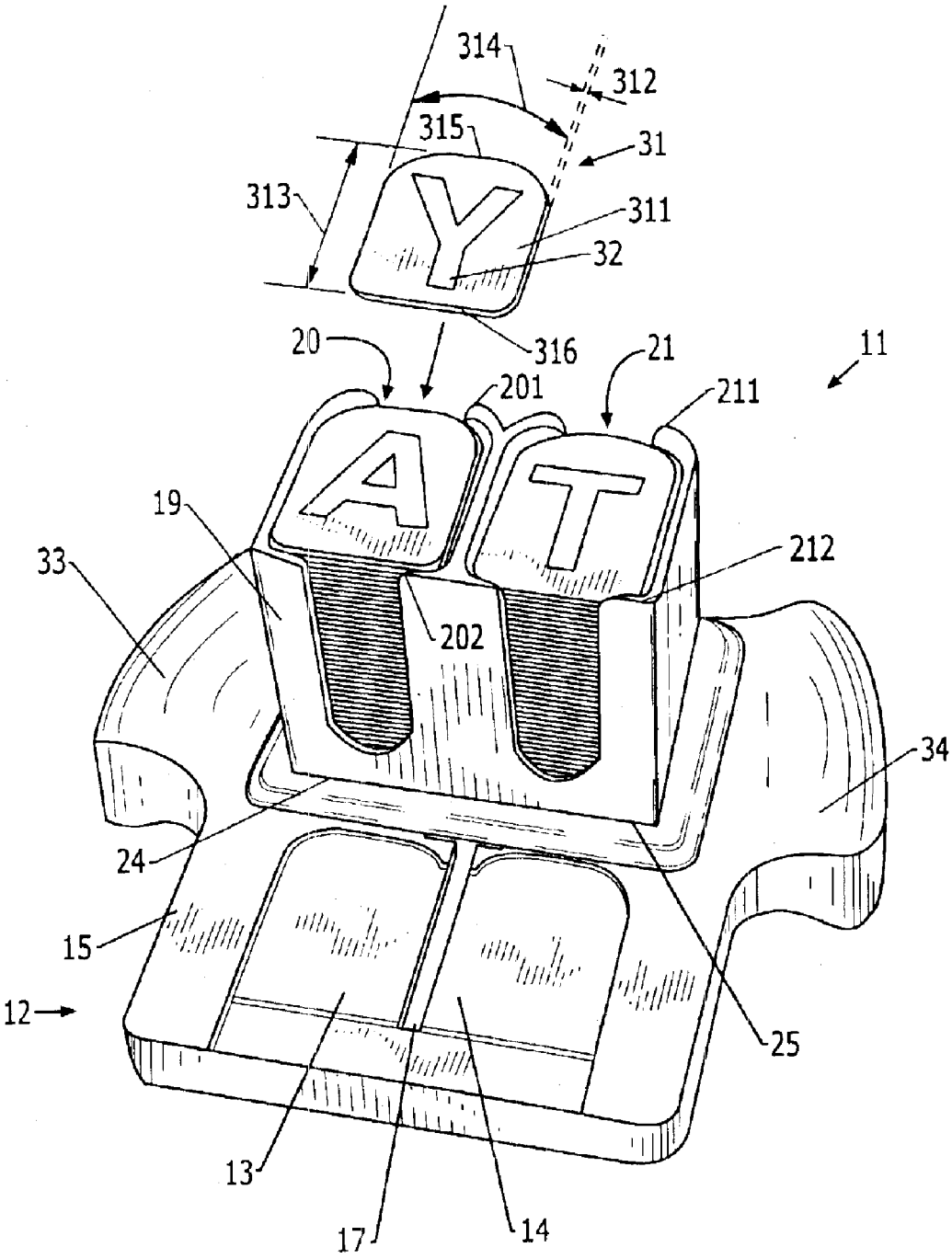
FIG. 2 is a top front perspective view of the uncovered dispenser being loaded.

In a preferred embodiment, the game pieces 31 are asymmetric, in order to ensure that the indicia 32 are facing in a desired direction, here, forward, upon being dispensed. In FIG. 2 it will be noted, for example, that the top edges 315 of the game pieces 31 are rounded and the bottom edges 316 substantially linear, as are the corresponding faces 201,211 and 202,212 of the receptacles 20,21. The game pieces 31 additionally have a length 313 greater than their width 314, also in order to ensure that the indicia 32 are facing forward when inserted and dispensed. In an alternate embodiment, the game pieces 31 that are to be loaded into the receptacles 20,21 are shaped differently so that one set is intended for being dispensed from the first receptacle 20 and a second set from the second receptacle 21. In yet another embodiment, the pieces 31 are shaped asymmetrically in the horizontal plane to ensure stacking with the indicia 32 facing upward.

There are also provided a number of exemplary versions of rule sets for the word game embodiment of the present invention. It is to be understood that these versions are intended to be suggestive of potential methods of playing the word game, and are not intended to be limiting.

Figure 3:
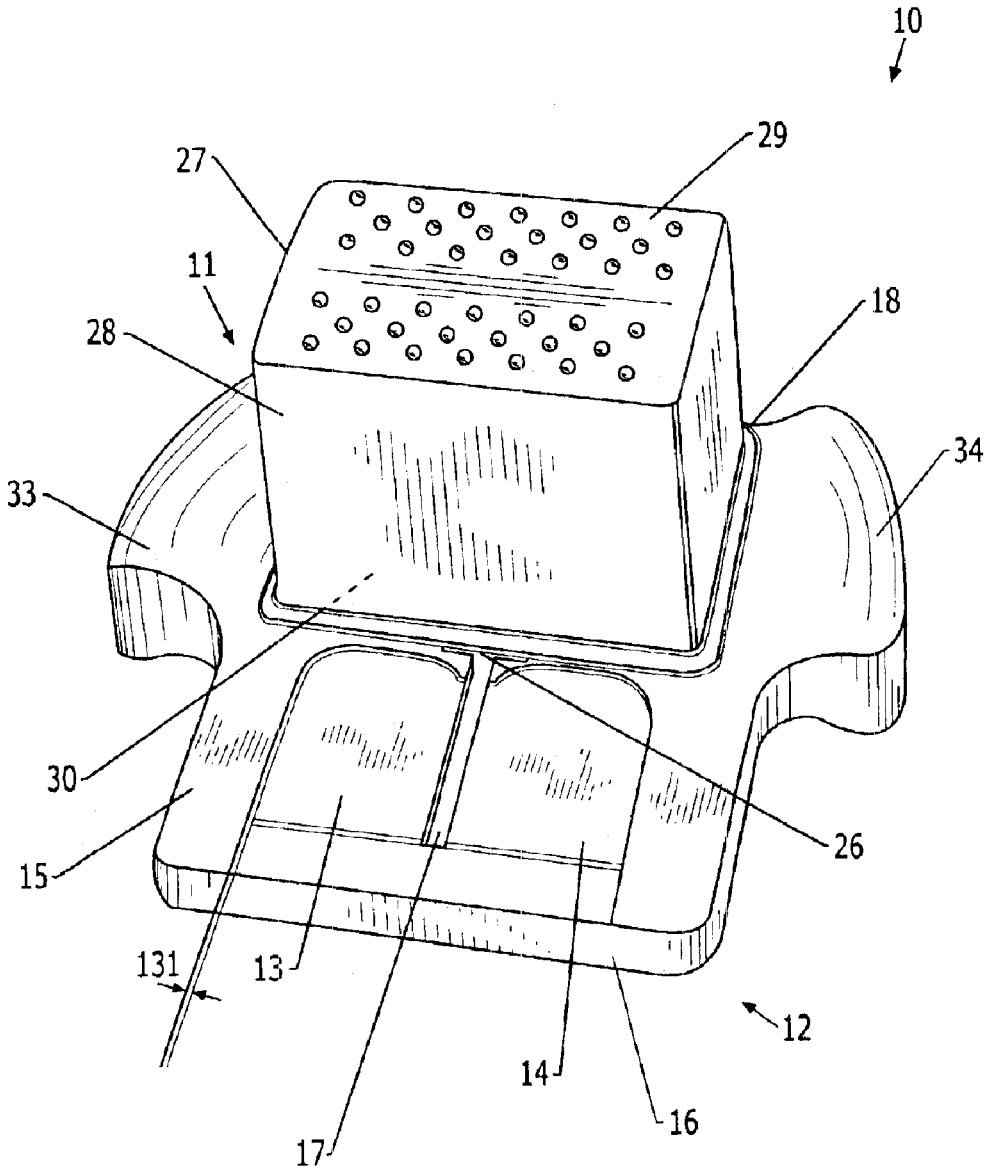
FIG. 3 is a top front perspective view of the covered dispenser in the rear position.

The initial steps for each game may be the same, including the players each picking a game piece 31 from a face-down position, the player with the letter closest to "A" becoming the "dealer." The dealer shuffles the game pieces 31, loads the receptacles 20,21 therewith, with the letters 32 facing upward (FIG. 2), and places the cover 27 over the game piece holder 19 (FIG. 3).

The dealer then operates the dispenser 11 by sliding it from the rear position to the forward position (FIG. 4) and back to the rear position (FIG. 5), effecting a depositing of two game pieces 31 into the depressions 13,14. The letter on the leftmost game piece 31 becomes the "start" letter; that on the rightmost game piece 31, the "stop" letter.

The Basic Word Game

The players attempt to form a word beginning with the first letter, which serves as a "start" letter, and ending with the second letter, which serves as a "stop" letter. The word should be required to have a minimum predetermined length, for example, five letters, although this rule can be changed commensurate with the age and ability of the players. For example, if the letters "M" and "C" are dispensed, the word magic would comprise an acceptable answer. The first player (or team) to call out a correct answer "wins" that round and collects the two dispensed game pieces 31.

A tie may result, for example, in the two game pieces 31 being placed in a "bonus" pile, to be collected by the winner of the next round.

Once all the game pieces 31 have been dispensed, the winner (or winning team) is the holder of the largest number of game pieces 31.

Additional rules may be imposed, such as the nonacceptability of plurals and/or proper nouns.

Variations of the basic game include limiting winning words to a particular part of speech or playing the game in another language.

"Word War"

In this variation, the players all write down as many words as possible using two letters as above. The player with the longest list wins that round.

"Trump Time"

This variation is played in similar fashion to the basic game, with the winner earning one game piece 31. Then the players attempt to create another word, longer than the first winning word, the second winner earning the second game piece 31. A time limit may be imposed.

"The Name Game"

The two dispensed letters are used as initials of noted people.

"Geography"

The two dispensed letters are used to form a place-name.

"Bogus Bluff"

A first player calls out a word having the "start" and "stop" letters as in the basic game. A second player can challenge the first player as to the authenticity of the word. The first player wins the tiles if no one challenges the authenticity of the word, or if the answer is challenged but found to be authentic. The second player wins the tiles if he or she mounts a successful challenge. In addition, challenges can yield more game pieces 31 from the challenge loser's pile if desired.

The Game as a Spelling Aid

The basic game can be played in a classroom setting, with the students either spelling their answers aloud or writing them down. The student with the most correct words wins the game.

The class can also be divided into two teams and arranged into rows. The first student in each row writes an answer on a blackboard with an imposed time limit from exposure of the letters, with the assistance of teammates. The next student in line writes words from the next-dispensed pair of game pieces 31.

A "Bingo"-Type Game

The apparatus 10 of the present invention may also be used to play a "Bingo"-type game, wherein the game-piece indicia 32 may comprise something other than a letter, such as a picture. In this embodiment, the players are provided with cards 35 (FIG. 7) having a matrix of indicia 36 thereon, each indicium positioned at a cell 37 of the matrix. Such cards 35 may comprise, for example, a "Bingo"-type card.

The players are also provided with markers 38 for covering indicia 36 on their cards 35 that correlate with a dispensed game piece 31. The rule set for this game would then include how a winner is declared, such as by forming a line of markers 38 as in Bingo, or in completely covering the matrix.

It will be understood by one of skill in the art that many variations of the basic game of the present invention, including the apparatus, the dispenser, and the rule sets, can be contemplated, and that no limitations are intended by the exemplary versions detailed herein. As disclosed above, dispensers may be envisioned by one of skill in the art having a multiplicity of receptacles for dispensing a multiplicity of game pieces. Further, word games may be envisioned wherein the dispensed game pieces are used in alternate positions to form a word.

In the foregoing description, certain terms have been used for brevity, clarity, and understanding, but no unnecessary limitations are to be implied therefrom beyond the requirements of the prior art, because such words are used for description purposes herein and are intended to be broadly construed. Moreover, the embodiments of the apparatus illustrated and described herein are by way of example, and the scope of the invention is not limited to the exact details of construction.

Having now described the invention, the construction, the operation and use of preferred embodiment thereof, and the advantageous new and useful results obtained thereby, the new and useful constructions, and reasonable mechanical equivalents thereof obvious to those skilled in the art, are set forth in the appended claims.

What is claimed is:

1. A game piece dispenser comprising:

a base having a first and a second depression in a top face thereof, the first and the second depression closer to a front edge than to a rear edge of the base and having a depth dimensioned to hold a unitary game piece therein; and a game-piece holder comprising a first and a second receptacle, each adapted to hold a plurality of stackable, substantially planar game pieces and each having an opening at a bottom end thereof, the game-piece holder slidably affixed atop the base and movable between a rear position wherein the first and the second receptacle openings are in spaced relation from the first and the second depression, respectively, and a forward position wherein the first and the second receptacle openings are in covering relation to the first and the second depression, respectively.

2. The dispenser recited in claim 1, wherein:

the base has a slot therein extending generally perpendicular to the front edge;

the game-piece holder having a slide member extending therebeneath, the slide member having a top portion dimensioned to slide within the slot and a bottom portion positioned beneath the slot and dimensioned larger than the slot.

3. The dispenser recited in claim 1, wherein the base further has a pair of laterally extending wings adjacent the rear edge for permitting a user to grasp a one of the wings with a first hand while sliding the game-piece holder with a second hand.

4. The dispenser recited in claim 1, further comprising a removable cover dimensioned to cover at least a portion of the game-piece holder for concealing game pieces residing within the first and the second receptacle when in use.

5. The dispenser recited in claim 1, wherein the first and the second receptacle each have an asymmetric shape, for holding asymmetrically shaped game pieces therein.

6. A game apparatus comprising:

a game piece dispenser comprising:

a base having a first and a second depression in a top face thereof, the first and the second depression closer to a front edge than to a rear edge of the base; and a game-piece holder comprising a first and a second receptacle, each having an opening at a bottom end thereof, the game-piece holder slidably affixed atop the base and movable between a rear position wherein the first and the second receptacle openings are in spaced relation from the first and the second depression, respectively, and a forward position wherein the first and the second receptacle openings are in covering relation to the first and the second depression, respectively;

a plurality of game pieces adapted to be held in a stacked configuration within a one of the first and the second receptacle, each game piece dimensioned to reside entirely within a one of the first and the second depression, the first and the second depression having a depth insufficient to contain more than one game piece, each game piece having an indicium on at least one face thereof.

7. The game apparatus recited in claim 6, further comprising a removable cover dimensioned to cover at least a portion of the game-piece holder for concealing the indicia of game pieces residing within the first and the second receptacle when in use.

8. The game apparatus recited in claim 6, wherein the first and the second receptacle each has an asymmetric shape in horizontal cross-section, and each of the plurality of game pieces has an asymmetric shape adapted for insertion into the first and the second receptacle, for preserving directionality of insertion thereinto.

9. The method recited in claim 8, wherein the first and the second receptacle are shaped differently, and the plurality of game pieces comprises a first and a second plurality of game pieces, each of the first plurality of game pieces having a different shape from a shape of each of the second plurality of game pieces, the first plurality of game pieces adapted for insertion into the first receptacle and the second plurality of game pieces adapted for insertion into the second receptacle.

10. A method of playing a game comprising the steps of:

dispensing a first game piece and a second game piece having indicia thereon for display to a plurality of players from a game-piece dispenser, the dispenser comprising:

a base having a first and a second depression in a top face thereof, the first and the second depression closer to a front edge than to a rear edge of the base and having a depth dimensioned to hold a unitary game piece therein; and a game-piece holder comprising a first and a second receptacle, each adapted to hold a plurality of stackable, substantially planar game pieces and each having an opening at a bottom end thereof, the game-piece holder slidably affixed atop the base and movable between a rear position wherein the first and the second receptacle openings are in spaced relation from the first and the second depression, respectively, and a forward position wherein the first and the second receptacle openings are in covering relation to the first and the second depression, respectively; and permitting the plurality of players to perform a game move utilizing the indicia on the first and the second game piece, the game move governed by an established rule set.

11. The method recited in claim 10, wherein the dispensing step comprises sliding the game-piece holder from the rear position to the forward position and then back to the rear position in order to deposit a first and a second game piece into the first and the second depression, respectively.

12. The method recited in claim 11, further comprising the step, prior to the dispensing step, of loading a plurality of game pieces into each of the first and the second receptacle, a face bearing the indicium on each game piece facing upward.

13. The method recited in claim 12, wherein the dispenser further comprises a removable cover and further comprising the step, following the loading step, of placing the cover over the game-piece holder to conceal the game-piece indicia from the players.

14. The method recited in claim 10, wherein the base further has a pair of laterally extending wings adjacent the rear edge, and wherein the dispensing step comprises grasping a one of the wings with a first hand while sliding the game-piece holder between the rear position and the forward position with a second hand.

15. The method recited in claim 10, wherein the game move comprises covering an indicium of a game card matrix with a marker, and wherein the rule set comprises permitting a marker to be placed on an indicium of the game card matrix when the indicium correlates with a one of the indicia on the game pieces dispensed into the first and the second depressions.

16. A method for fabricating a game apparatus comprising the steps of:

fabricating a game piece dispenser comprising:

a base having a first and a second depression in a top face thereof, the first and the second depression closer to a front edge than to a rear edge of the base; and a game-piece holder comprising a first and a second receptacle, each having an opening at a bottom end thereof, the game-piece holder slidably affixed atop the base and movable between a rear position wherein the first and the second receptacle openings are in spaced relation from the first and the second depression, respectively, and a forward position wherein the first and the second receptacle openings are in covering relation to the first and the second depression, respectively;

fabricating a plurality of game pieces adapted to be held in a stacked configuration within a one of the first and the second receptacle, each game piece dimensioned to reside entirely within a one of the first and the second depression, the first and the second depression having a depth insufficient to contain more than one game piece, each game piece having an indicium on at least one face thereof;

printing a rule set for the game; and packaging the dispenser, the game pieces, and the printed rule set together.

17. The method recited in claim 16, further comprising the step of fabricating a removable cover dimensioned to cover at least a portion of the game-piece holder for concealing the indicia of the game pieces residing within the first and the second receptacle when in use.

* * * * *